United States Patent [19]

Muramatu et al.

[11] Patent Number: 4,988,030

[45] Date of Patent: Jan. 29, 1991

[54] PRINTED RECORDING PAPER PROCESSING APPARATUS

[75] Inventors: Takeshi Muramatu, Sayama; Masaaki Sekiguchi, Asaka; Tsugio Hirabayashi, Hachioji, all of Japan

[73] Assignee: Konica Corporation, Tokyo, Japan

[21] Appl. No.: 327,498

[22] Filed: Mar. 23, 1989

[30] Foreign Application Priority Data

Apr. 7, 1988 [JP] Japan ..... 63-87589

[51] Int. Cl.[5] ..... B42B 2/00

[52] U.S. Cl. ..... 227/27; 270/53

[58] Field of Search ..... 83/105, 109, 165; 412/13, 43; 227/27; 270/53

[56] References Cited

U.S. PATENT DOCUMENTS

| | | | |
|---|---|---|---|
| 1,582,204 | 4/1926 | Woodall et al. | 83/165 |
| 4,293,366 | 10/1981 | Szanto et al. | 412/43 |
| 4,373,713 | 2/1983 | Loebach | 271/303 |
| 4,846,616 | 7/1989 | Abilgaard et al. | 412/7 |
| 4,898,372 | 2/1990 | Hirabayashi et al. | 270/53 |

FOREIGN PATENT DOCUMENTS

| | | |
|---|---|---|
| 61-84662 | 4/1986 | Japan . |
| 61-94180 | 5/1986 | Japan . |
| 63-185774 | 8/1988 | Japan . |
| 63-300897 | 12/1988 | Japan . |

OTHER PUBLICATIONS

Paper Handling Technology of Multi Functional Duplicator, Tesuo Sakurai, Hisahide Yushita, Goro Mori, Mar. 3, 1985.

*Primary Examiner*—Frank T. Yost
*Assistant Examiner*—John M. Husar
*Attorney, Agent, or Firm*—Finnegan, Henderson, Farabow, Garrett, and Dunner

[57] ABSTRACT

For use in a photocopying machine, an apparatus for making punch holes in and stapling recording sheets comprising, a first conveyer by which the recording sheets are conveyed to a sheet stacker which is capable of setting the recording sheets at a predetermined position for sheet processing, a sheet processor which has a hole puncher and a stapler by which the recording sheets are processed to have punch holes or to be stapled, or both, in which the hole puncher is provided with an angled panel attached below a die of the hole puncher so that paper pieces punched from punch holes are received without clogging into a container for disposal, and a second conveyer by which the processed sheets are conveyed to a sheet receiving tray.

4 Claims, 10 Drawing Sheets

PRINTED RECORDING PAPER PROCESSING APPARATUS

BACKGROUND OF THE INVENTION

The present invention relates to a printed recording paper processing apparatus suitable for use in combination with a recording apparatus, such as a copying machine.

In preparing materials for a conference or pamphlets for distribution by collecting printed recording papers produced by a recording apparatus, such as a copying machine, the printed recording papers must be collected, collated, folded, punched and/or bound. Sorters for sorting copies, automatic punching machines, automatic folding machines, automatic collators and paper processing machines integrally having the functions of those single-purpose paper processing machines have been proposed, for example, in Japanese Patent Laid-open (Kokai) Nos. 61-94180 and 61-84662, and Denshi Shashin Gakkai-shi, Vol. 24, No. 3, pp. 188–194 (1985) to improve the total efficiency of copying work including the foregoing paper processing operations by automating those paper processing operations.

In most cases, a set of printed recording papers are bound together with staples or filed for use and storage. However, there has not been proposed any paper processing machine capable of simultaneously punching and binding printed recording papers.

The inventors of the present invention proposed a printed recording paper processing apparatus in Japanese Patent Laid-open No. 62-12201. This printed recording paper processing apparatus proposed previously by the inventors of the present invention comprises: an intermediate storage unit for storing a set of printed recording papers delivered sequentially thereto one at a time in a pile in the order of delivery; a processing unit for selectively punching or binding the set of printed recording papers at the place of storage; a storage unit for storing the processed set of printed recording papers; first conveying means for conveying printed recording papers to the intermediate storage unit; and second conveying means for conveying the processes set of printed recording papers to the storage unit. The use of this printed recording paper processing apparatus in combination with a recording apparatus, such as an electrophotographic copying machine, enables automatic punching or automatic binding of a set of printed recording papers produced by the recording apparatus facilitating the preparation of materials for conferences and the making of pamphlets for distribution.

In punching a set of printed recording papers by a motor-driven punching machine incorporated into such a printed recording paper processing apparatus, a considerably large force must be applied to the punching pins and the force increases with the number of printed recording papers. Accordingly, the punching machine must be provided with a motor having a large capacity.

To enable punching a comparatively thick pile of printed recording papers by a punching machine equipped with a driving motor having a comparatively small capacity, the inventors of the present invention proposed a printed recording paper processing apparatus capable of automatic punching and binding in Japanese Patent Laid-open (Kokai) No. 62-131608. The punching pins of a punching machine incorporated into this printed recording paper processing apparatus are driven sequentially in different phases for punching operation. This printed recording paper processing apparatus, however, has a problem that the backside of the die is jammed with punched scraps to increase load on the punching machine excessively causing the punching machine to malfunction.

SUMMARY OF THE INVENTION

Accordingly, it is an object of the present invention to provide a printed recording paper processing apparatus capable of automatic punching and binding, equipped with a punching machine capable of being driven by a driving motor of a comparatively small capacity and capable of obviating jamming with punched scraps.

To achieve the object of the invention, the present invention provides a printed recording paper processing apparatus having a punching unit for punching a pile of printed recording papers, comprising punching pins, a die disposed opposite the punching pins, and a punching pin driving mechanism, characterized in that punched scraps are extruded from the bottom of the die, and the extruded punched scraps are bent by punched scrap bending members disposed near the bottom of the die.

BRIEF DESCRIPTION OF THE DRAWINGS

The above and other objects, features and advantages of the present invention will become more apparent from the following description taken in conjunction with the accompanying drawings, in which.

DETAILED DESCRIPTION OF THE PREFERRED EMBODIMENT

Prior to the description of the printed recording paper processing apparatus 1, the copying machine will be described briefly.

Figure 1:
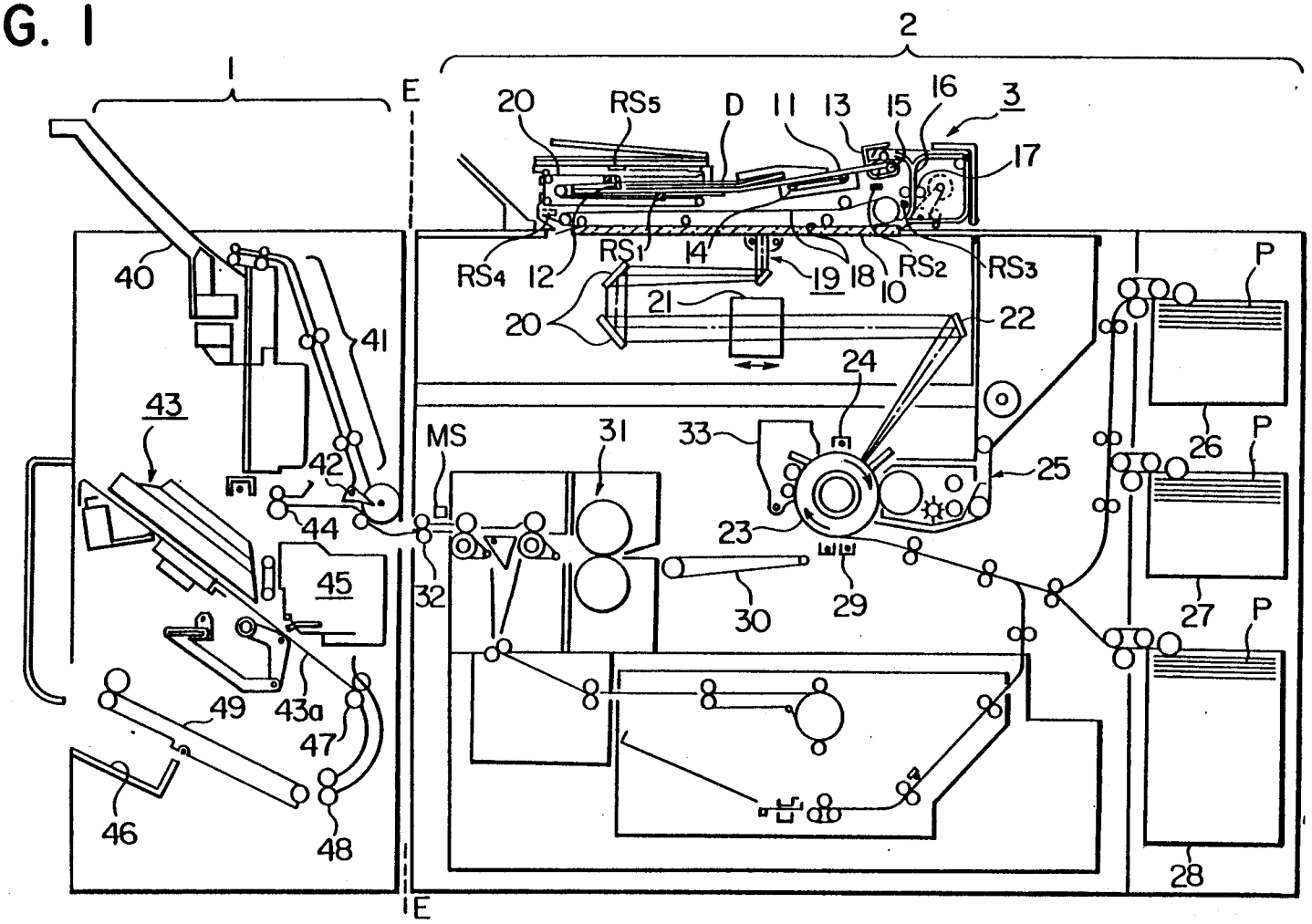
FIG. 1 is a sectional view of a copying machine equipped with a printed recording paper processing apparatus in a preferred embodiment according to the present invention.

Referring to FIG. 1, a printed recording paper processing apparatus 1 embodying the present invention is coupled with a copying machine 2 along a broken line E.

Since the printed recording paper processing apparatus 1 punches and/or binds printed recording papers produced from copying documents, such as a plurality of pages of a book, to provide at least one copy of printed recording papers, the copying machine 2 must be capable of sequentially and repeatedly copying the documents. Therefore, the copying machine 2 must be equipped with an automatic document recirculating device 3. The copying machine 2 and the automatic document recirculating device 3 are of generally known construction and capable of known functions. As FIG. 1 shows, the automatic document recirculating device 3 is disposed over the copying machine 2. Documents to be copied are fed sequentially one at a time by the automatic document recirculating device 3, and the documents are copied by a known electrophotographic process.

The automatic document recirculating device 3 is disposed over a platen glass 10 disposed on the upper surface of the copying machine 2. A set of a plurality of documents D to be copied are stacked in a pile on a document tray 11 in order of page number with the first page on the top of the pile. A first sensor $RS_1$ detects the presence of the documents D on the document tray 11. Upon the depression of a copy start button provided on the control panel of the copying machine 2, a rear edge adjusting plate 12 included in the automatic document recirculating device 3 advances to shove the pile of the documents D to the front (rightward as viewed in FIG. 1) and a gate 13 disposed on a document feed path moves up. Upon the detection of the front edges of the documents D by a second sensor $RS_2$ for detecting the front edges of the documents D after the documents D have been advanced past the gate 13 by some distance, the rear edge adjusting plate 12 is stopped, the gate 13 is lowered, and then the rear edge adjusting plate 12 is retracted.

Then, the copying machine 2 provides a document feed signal at a predetermined time point in a copying cycle. Then, a semicircular feed roller 14 makes one full turn and a separator roller 15 turns to feed a first sheet of document D, namely, a bottom document. The first document is conveyed forward along a guide plate 16 and is delivered by a delivery roller 17 to a first belt conveyor 18, which conveys the first document at a predetermined speed along the platen glass 10 of the copying machine 2. Upon the passage of the front edge of the first document across a predetermined position, a third sensor $RS_3$ for timing the recording paper feed operation gives a detection signal to the copying machine 2, and then the copying machine 2 starts feeding a recording paper. The first document is exposed by an optical system 19 provided under the platen glass 10, including an illuminating lamp and reflecting mirrors, while the first document is being conveyed along the platen glass 10. After the exposure of the first document has been completed, a fourth sensor $RS_4$ detects the first document, and then a second belt conveyor 20 conveys the first document to the document tray 11 and is placed on top of the pile of the rest of the documents D. The removal of the first document from the platen glass 10 is detected by a fifth sensor $RS_5$. The jam of the copying machine with the document can be detected from the difference between a time point when the third sensor $RS_3$ detects the document and a time point when the fourth sensor $RS_4$ detects the document. Upon the detection of the rear edge of the first document by the third sensor $RS_3$, the automatic document recirculating device 3 starts feeding a second document. Similarly, the rest of the documents D are subjected sequentially to the exposure process. Thus, all the documents D are fed sequentially to produce a copy of reproductions of the documents D. The document feeding is finished as the second sensor $RS_2$ detects no documents remaining. When a plurality of copies, for example, five copies, of reproductions of the documents are required, the documents D are subjected to the exposure process for the number of times corresponding to the necessary number of copies.

The copying machine 2 carries out the following electrophotographic process in synchronism with the foregoing document recirculating operation of the automatic document recirculating device 3.

The optical system 19 illuminates the document being conveyed at a predetermined constant speed along the platen glass 10. The light reflected from the document passes through a mirror 20, a lens 21 and a mirror 22 and is projected on the surface of a photosensitive drum 23 uniformly charged by a charging unit 24 to form an electrostatic latent image on the uniformly charged surface of the photosensitive drum 23. Then, a developing unit 25 develops the electrostatic latent image into a visible toner image. A transfer unit 29 transfers the toner image to a recording paper P fed from one of recording paper feed cassettes 26, 27 and 28 in synchronism with the automatic document feed operation. Then, a separating device separates the recording paper P carrying the toner image from the surface of the photosensitive drum 23, a belt conveyor 30 conveys the recording paper P to a fixing unit 31, the fixing unit fixes the toner image on the recording paper P, and then a discharge roller 32 discharges the recording paper P from the copying machine. A cleaning device 33 removes the toner remaining over the surface of the photosensitive drum 23 after the recording paper P has been removed from the surface of the photosensitive drum 23 to clean the surface of the same.

Although the foregoing copying machine is of a most simple construction for copying a document printed one side to one side of a recording paper, naturally, it is possible to use the printed recording paper processing apparatus of the present invention in combination with a copying machine other than the foregoing copying machine, such as a copying machine capable of copying documents each printed on both sides to both sides of a recording paper, or with a copying machine capable of copying a document printed on both sides to one side of recording paper or to both sides of a recording paper. The copying machine 2 and the automatic document recirculating device 3 must be provided with additional mechanisms for inverting the document and for inverting the recording paper to realize the copying mentioned above. However, those mechanisms are well known ones and are not the subject matter of the present invention, and hence the description thereof will be omitted.

Referring to FIG. 1 again, the printed recording paper processing apparatus 1 embodying the present invention comprises a conveyor roller arrangement 41 for delivering printed recording papers F produced by and discharged from the copying machine 2 directly to a printed recording paper delivery tray 40 without punching or binding the printed recording papers F, an intermediate stacking unit 43 for storing the printed recording papers F for the subsequent punching and/or binding process, a switching gate 42 for guiding the printed recording papers F to the printed recording paper delivery tray 40 or to the intermediate stacking unit 43, a conveyor roller arrangement 44 for conveying the printed recording papers F to the intermediate stacking unit 43, a processing unit 45 for punching and/or binding a copy of the printed recording papers F, a copy storage tray 46 for storing a copy or copies of the printed recording papers F, and conveyor rollers 47 and 48 for conveying the copy of the printed recording papers F to the copy storage tray 46.

The processing unit 45 comprises a punching unit and a pair of binding units, namely, so-called staplers, disposed on the opposite sides of the punching unit. The processing unit 45 can be drawn out from one side of the printed recording paper processing apparatus to remove punched scraps, to replenish the binding units with staples or to remove staples accidentally clogging the binding units.

Figure 2:
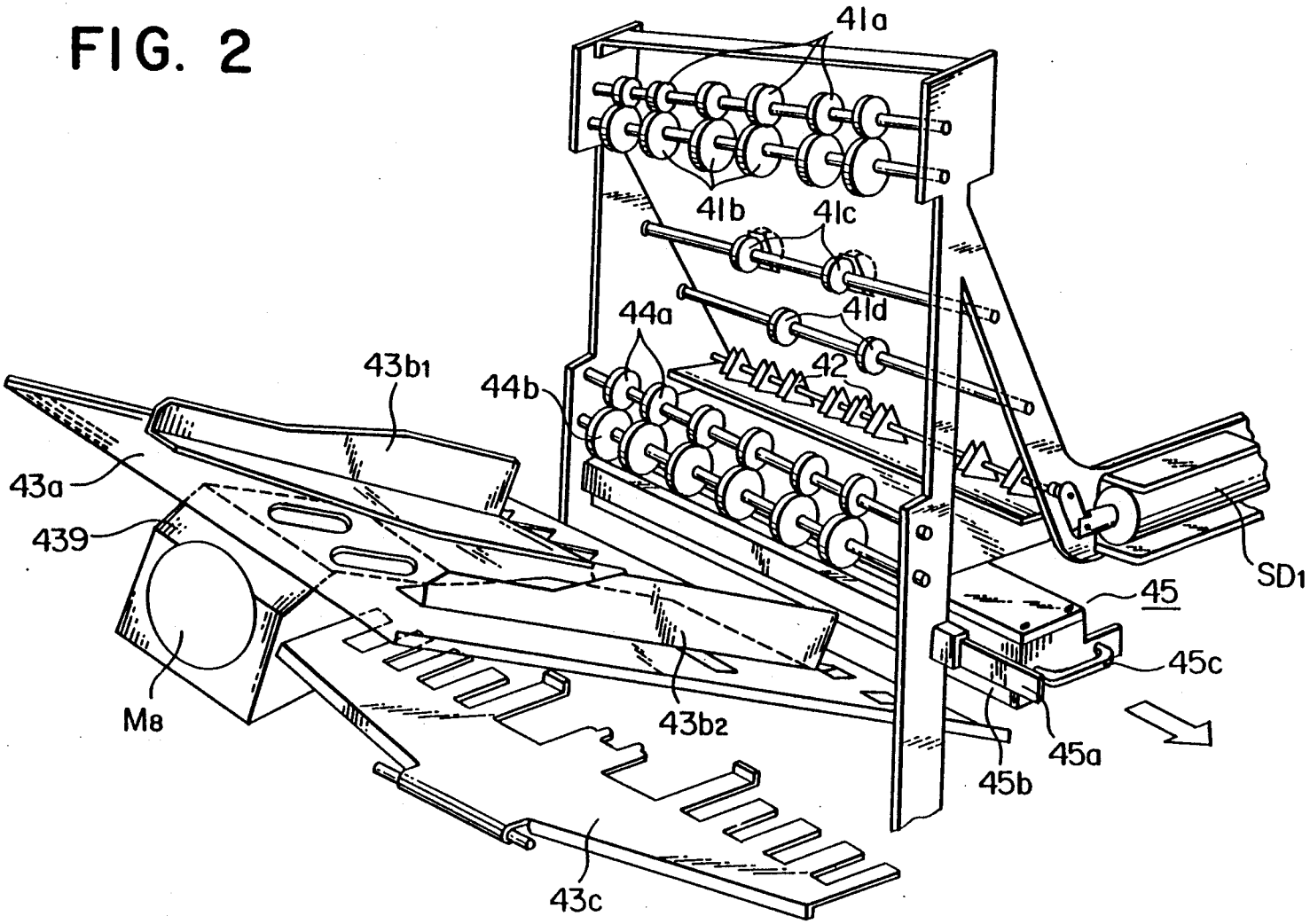
FIG. 2 is a perspective view of an essential portion of the printed recording paper processing apparatus.

Referring to FIG. 2, the conveyor roller arrangement 41 comprises rollers 41*a*, 41*b*, 41*c* and 41*d*. The switching gate 42 is driven by a first solenoid $SD_1$ between a first position and a second position The switching gate 42 is at the first position to guide the printed recording paper F to the printed recording paper delivery tray 40 when the first solenoid $SD_1$ is not energized, and is at the second position to guide the printed recording paper F to the intermediate stacking unit 43 when the first solenoid $SD_1$ is energized. The conveyor roller arrangement 44 comprises rollers 44*a* and 44*b*.

The intermediate stacking unit 43 comprises an inclined plate 43*a*, a pair of adjustable side plates $43b_1$ and $43b_2$ slidably provided on the upper surface of the inclined plate 43*a*, and a stopper 43*c* disposed directly below the inclined plate 43*a*. The interval between the side plates $43b_1$ and $43b_2$ is adjustable. The stopper 43*c* can be moved forward or backward.

Figure 3:
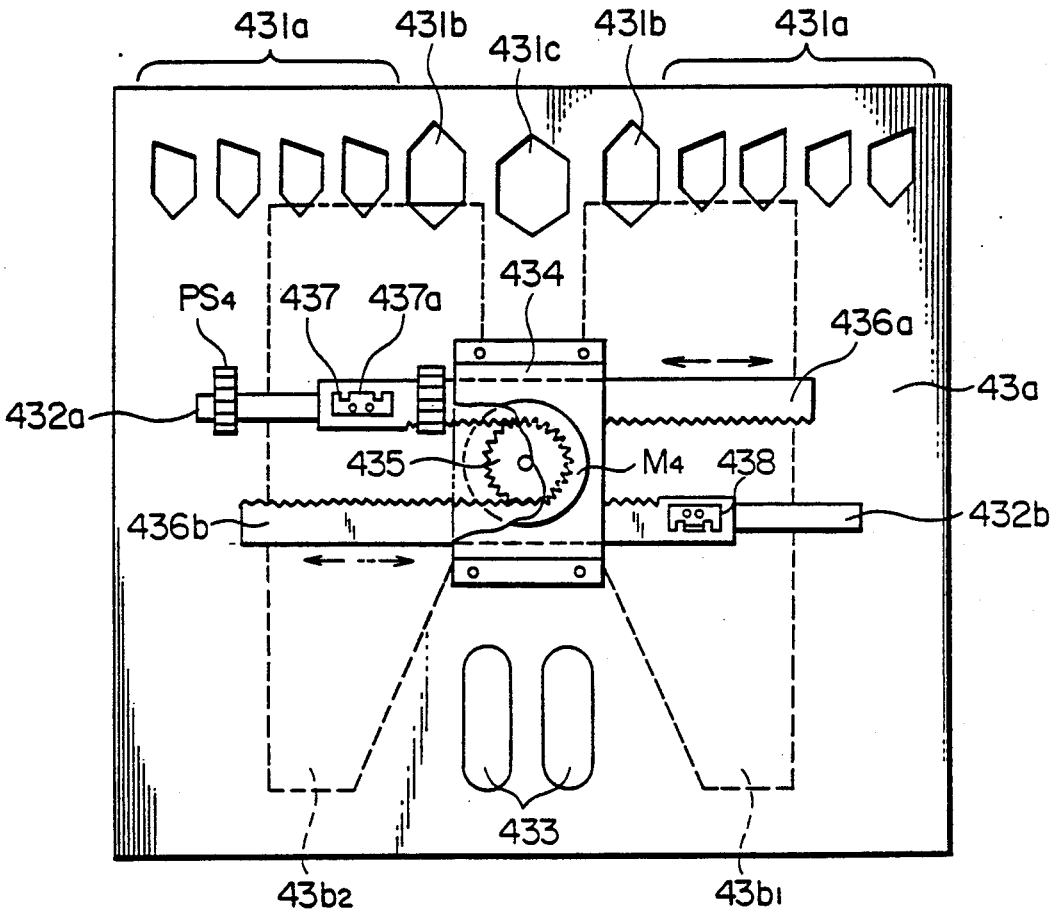
FIG. 3 is a rear elevation of an inclined plate included in the printed recording paper processing apparatus.

Referring to FIG. 3, the inclined plate 43*a* has a plurality of openings 431*a*, 431*b*, 431*c* near the front edge thereof, two lateral slots 432*a* and 432*b* in the central portion thereof, and a hole 433 near the rear edge thereof for blowing air therethrough. A bracket 434 is attached to the backside of the inclined plate 43*a* and a motor $M_4$ for adjusting the interval between the side plates $43b_1$ and $43b_2$ is mounted on the bracket 434. A pinion 435 is fixed to the output shaft of the motor $M_4$. Two racks 436*a* and 436*b* are disposed in parallel to each other are connected fixedly to the side plates $43b_1$ and $43b_2$ provided on the upper surface of the inclined plate 43*a* by connecting members 437 and 438, respectively. The pinion 435 is in mesh with the racks 436*a* and 436*b*. The racks 436*a* and 436*b* have each a longitudinal rib on the upper surface thereof. The longitudinal ribs are slidably fitted respectively in the slots 432*a* and 432*b*. An optical sensor $PS_4$ for detecting the arrival of the side plates $43b_1$ and $43b_2$ at a home position (reference position) is provided near one end of the slot 432*a*. When the side plates $43b_1$ and $43b_2$ are at the home position, a lug 437*a* formed in the connecting member 437 intercepts a light beam falling on the optical sensor $PS_4$. When the output shaft of the motor $M_4$ turns in the normal direction or in the reverse direction through a predetermined angle, the racks 436*a* and 436*b* move by a corresponding distance in the direction indicated by an arrow of continuous lines or in the direction indicated by an arrow of broken lines to move the side plates $43b_1$ and $43b_2$ away from each other or toward each other.

As shown in FIG. 2, a motor $M_8$ for driving a blower and a duct 439 are disposed near the opening 433, and are attached to the backside of the inclined plate 43*a*.

Figure 4:
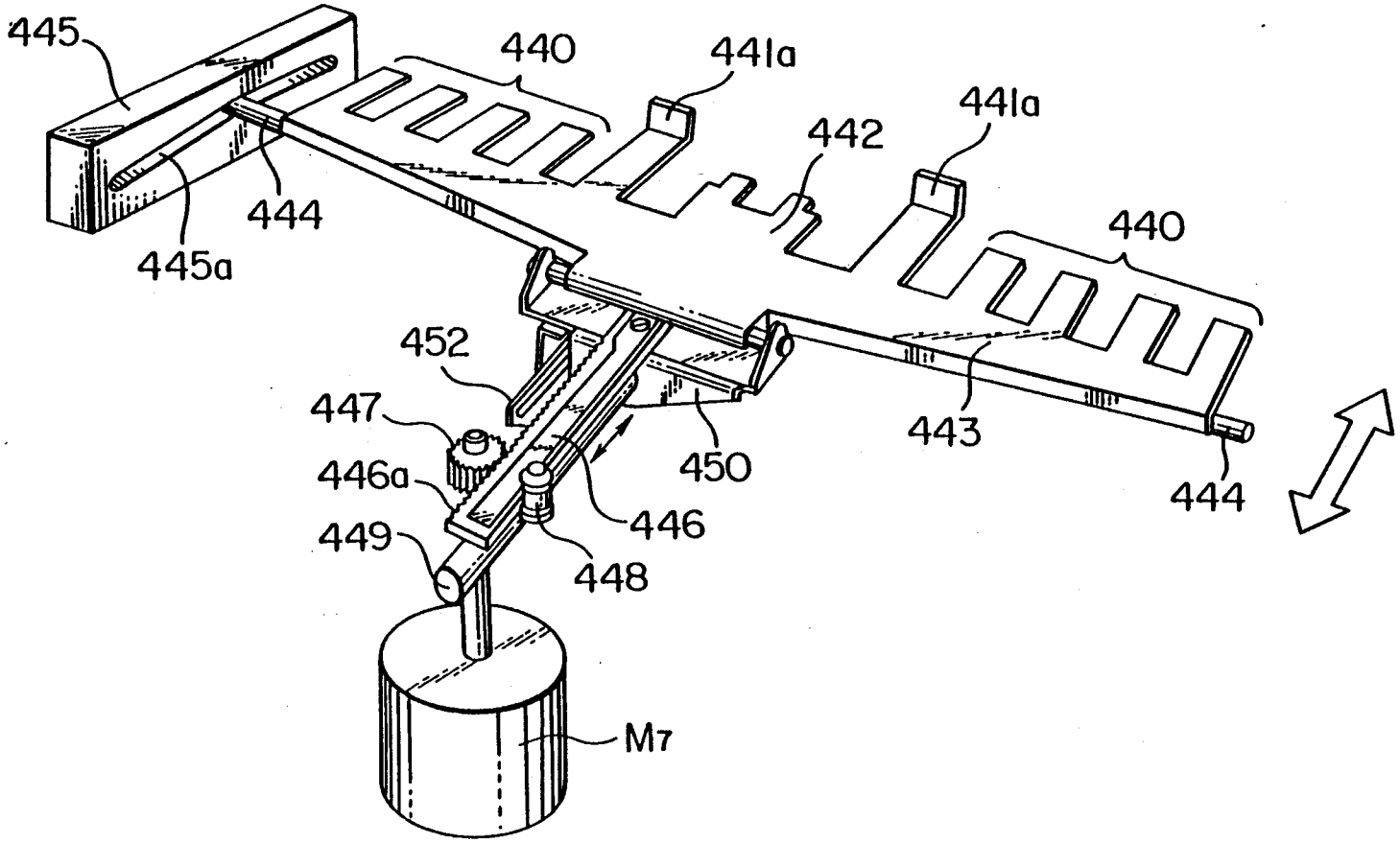
FIG. 4 is a perspective view of a stopper driving mechanism included in the printed recording paper processing apparatus.

Referring to FIG. 4, the stopper 43*c* has a plate member 443 having a plurality of fingers 440 extending to the front, two projections 441 having upright extremities forming upright lugs 441*a*, and a wide central projection 442, and pins 444 projecting respectively from the opposite sides of the plate member 443. The pins 444 are received in grooves 445*a* formed respectively in guide members 445 (only the left guide member is shown in FIG. 4) formed of a resin and fixed to the frame of the printed recording paper processing apparatus. A driving rod 446 is attached to the central portion of the plate member 443 and a rack 446*a* formed in the extremity of the driven rod 446 is disposed to a pinion 447. The pinion 447 is driven by a motor $M_7$, and as pinion 447 rotates in the normal or reverse direction to move the drive rod 446 in a direction indicated by the arrow, the plate member 443 is moved forward or backward in the direction of the blank arrow as the pins 444 projecting from the opposite sides thereof are guided by the grooves 445*a* of the guides 445.

The stopper 43*c* is disposed relative to the inclined plate 43*a* so that the fingers 440 and projections 441 and 442 of the plate member 443 are located respectively at positions corresponding to the openings 431*a*, 431*b* and 431*c* and project upward of the inclined plate 43*a* respectively through the corresponding openings 431*a*, 431*b* and 431*c* when the plate member 443 advances. When the plate member 443 is advanced to the front position, the two projections project upward through the openings 431*b* to stop the printed recording papers which tend to slide down along the inclined plate 43*a* by the upright lugs 441*a*.

Figures 5A, 5B:
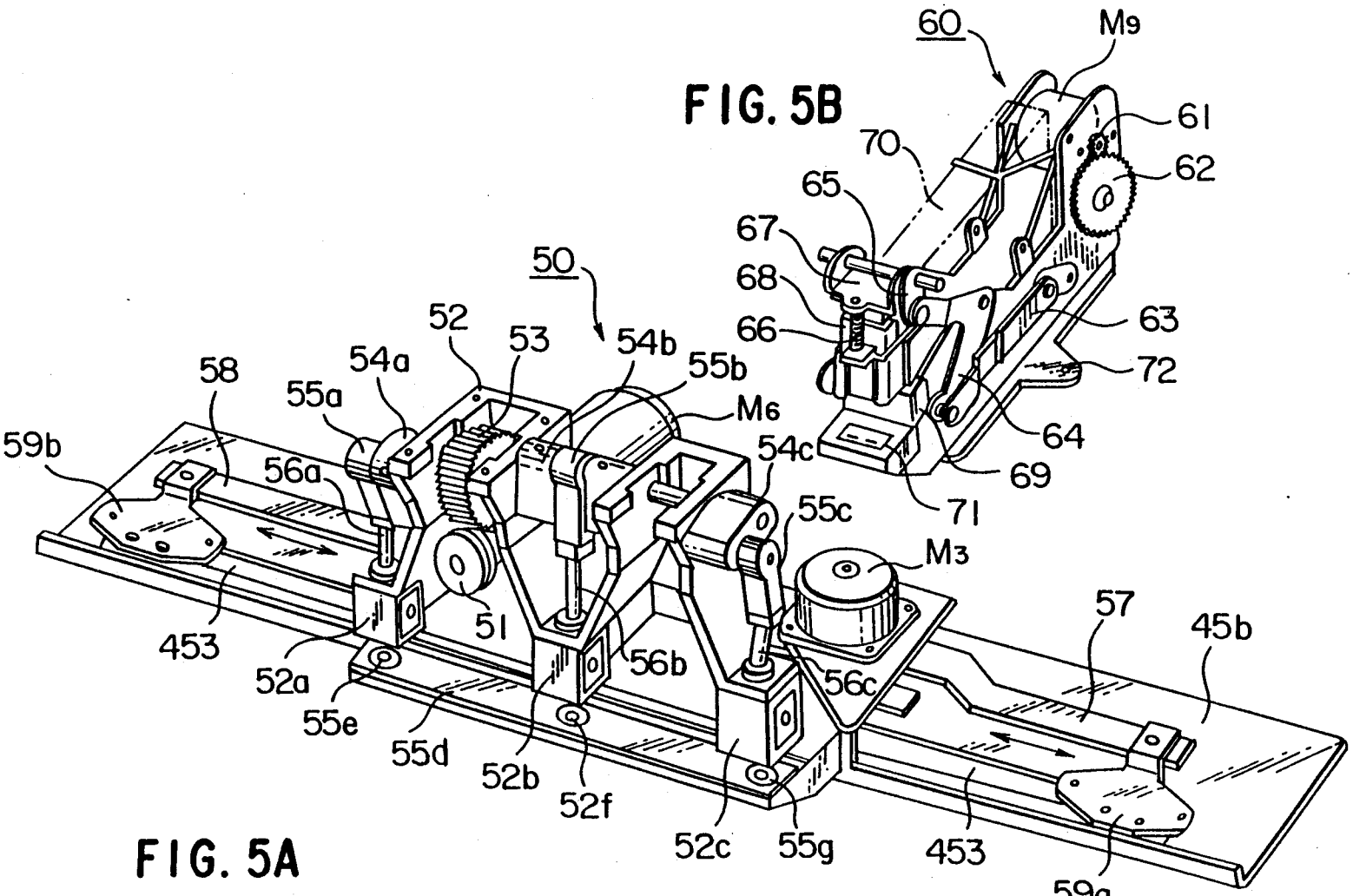
FIGS. 5*a* & 5*b* is a perspective view of the printed recording paper processing apparatus, in which a binding unit is removed.

Referring to FIGS. 2 and 5, the punching unit 50 and the binding units 60 of the processing unit 45 are mounted on a frame 45*b* which can be drawn out in a direction indicated by an arrow along guide rails 45*a* from the printed recording paper processing apparatus. As shown in FIG. 5, the punching unit 50 is disposed fixedly in the central portion of the frame 45*b*, and the two binding units 60 are arranged movably on the opposite sides of the binding unit 50. In FIG. 5, only one of the binding units 60 is shown.

The punching unit 50 comprises a motor $M_6$, a worm 51 fixed to the output shaft of the motor $M_6$, a worm wheel 53 fixed to a shaft journaled on a holder 52, and engaging the worm 51, three eccentric cams 54*a*, 54*b* and 54*c* fixed to the driving shaft on both sides of the worm wheel 53 at an angular pitch of 56°, swing arms 55*a*, 55*b* and 55*c* respectively coupled with the eccentric cams 54*a*, 54*b* and 54*c*, punching pins 56*a*, 56*b* and 56*c* extending from the lower ends of the swing arms 55*a*, 55*b* and 55*c*, respectively, pin guides 52*a*, 52*b* and 52*c* formed integrally with the holder 52 to guide the punching pins 56*a*, 56*b* and 56*c*, respectively, a horizontal table 55*c* forming a part of the holder 52, and dies 55*e*, 55*f* and 55*g* incorporated into the horizontal table 55*d* at positions respectively corresponding to the punching pins 56*a*, 56*b* and 56*c*.

When the output shaft of the motor $M_6$ rotates first in one direction and then in the opposite direction, the punching pins 56*a*, 56*b* and 56*c* are driven for vertical reciprocation through the worm 51, the worm wheel 53, the eccentric cams 54*a*, 54*b* and 54*c* and the swing arms 55*a*, 55*b* and 55*c* to punch a pile of printed recording papers placed on the horizontal table 55*d* in cooperation with the dies 55*e*, 55*f* and 55*g*. At positions slightly below the uppermost positions, the punching pins 56*a*, 56*b* and 56*c* are retracted into the pin guides 52*a*, 52*b* and 52*c*, respectively, so that punched scraps are removed without fail from the punching pins 56*a*, 56*b* and 56*c*. The punched scraps are stored in a tray (not shown) detachably provided below the horizontal table 55*d*.

Figure 6:
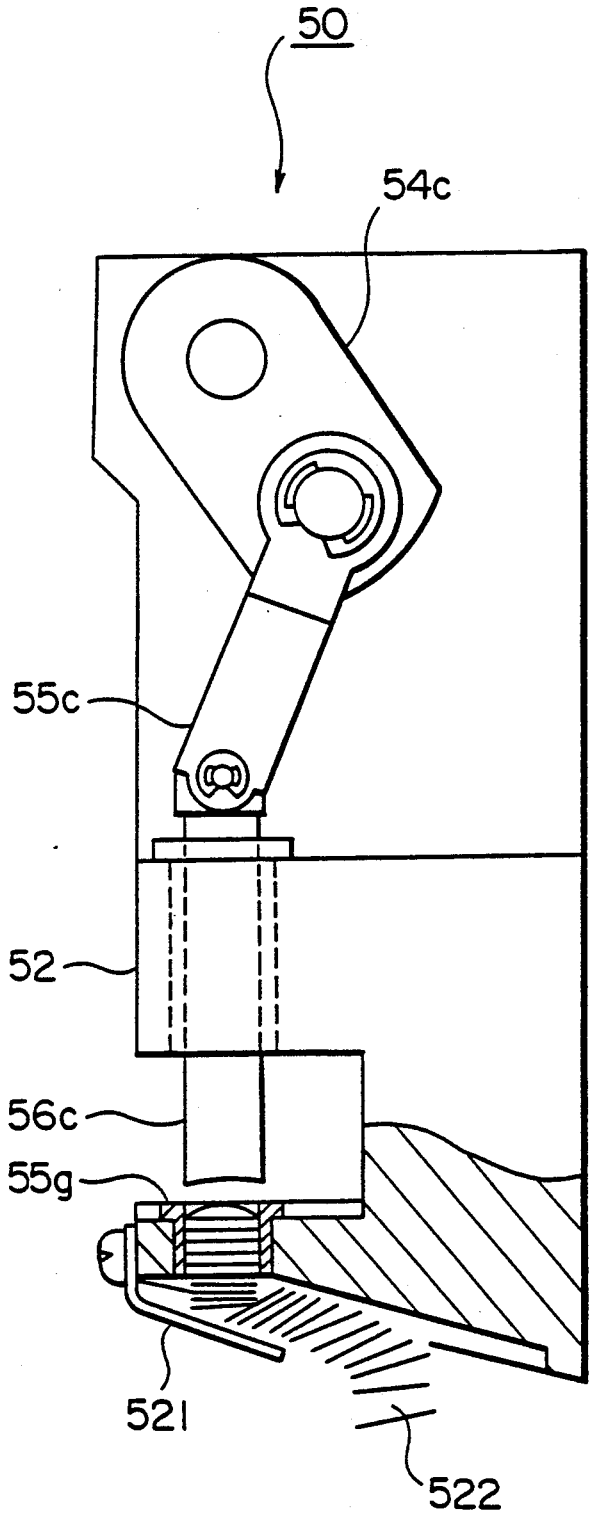
FIG. 6 is a fragmentary sectional view of a punching unit included in the printed recording paper processing apparatus.

Referring to FIG. 6, a bending member 521 according to this invention is formed by bending a thin metallic plate substantially in an L-shape. The bending member 521 is so disposed as to cover the dies 55 with a small gap therebetween with the shorter leg thereof screwed to the holder 52 and the longer leg thereof being opposite to the backside of the dies 55 with a small inclination. Punched scraps 522 are forcedly pressed against the inclined longer leg of the bending member 521 by the punching pins 56, whereby the punched scraps 522 are bent and separated from each other. Consequently, the bent punched scraps 522 are scattered piece by piece, and thus substantially will not cause a clog in the punched scrap container and can effectively use the capacity of the container to store them.

Referring to FIG. 5, two sliding racks 57 and 58 are extended in parallel to each other along the opposite longitudinal side edges of the frame 45*b* of the processing unit 45. There is a pinion, not shown, between the sliding racks 57 and 58 driven by a reversible motor $M_3$ forwardly or backwardly. The binding units 60 are connected to the ends of the sliding racks 57 and 58 by connecting plates 59*a* and 59*b*, respectively. The connecting plates 59*a* and 59*b* are guided for lateral movement by a guide rail 453 provided on the frame 45*b*. When the motor $M_3$ is actuated, the binding units 60 are moved toward or away from each other according to the movement of the sliding racks 57 and 58 by the motor $M_3$.

As shown in FIG. 5, each binding unit 60 has a crank, not shown, which is driven through gears 61 and 62 by a binding motor $M_9$ to drive a lever 63 for a relatively slow linear reciprocating motion. The lever 63 turns a V-shaped lever 64 on a pin A thereby a lever 65 is turned to compress a spring 66 through a U-shaped pressing member 67, whereby a thin plate 68 is depressed along a guide 69. Consequently, one of the staples contained in a cartridge 70 is separated from the rest of the staples and is pressed by the thin plate 68 to bind a pile of printed recording papers placed on a binding table 71. Bottom connecting plates 72 of the binding units 60 are fixed to the connecting plates 59*a* and 59*b*, respectively.

Thus, the binding units 60 are disposed respectively on the each side of the punching unit 50 of the processing unit 45, and the binding units 60 and the punching unit 50 are mounted on the frame 45*b*. Handle 45*c* (FIG. 2) is attached to the frame 45*b* to draw out the processing unit 45 laterally from one side of the printed recording paper processing apparatus in a direction indicated by an arrow. The processing unit 45 is drawn out by pulling the handle 45*c* to remove punched scraps accumulated in the tray or to remove staples accidentally clogging the binding units 60.

Figure 7:
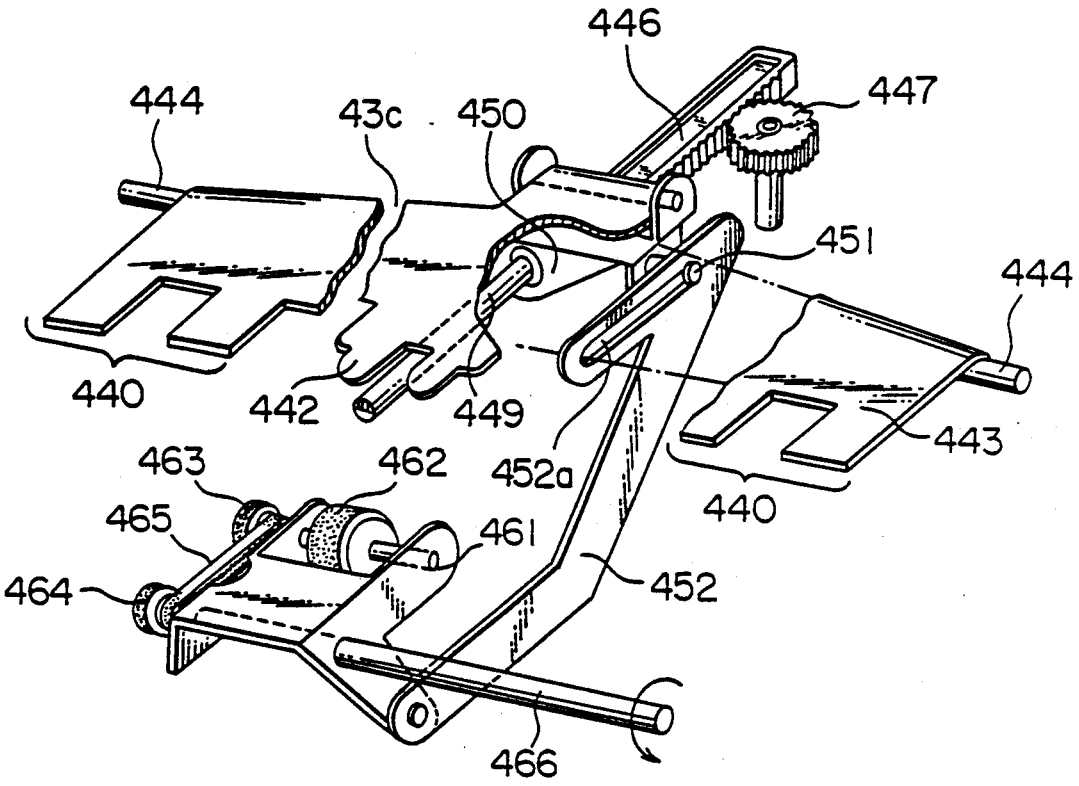
FIG. 7 is a perspective view of a recording paper feed mechanism.

Referring to FIG. 7 showing delivery mechanism for delivering a copy of printed recording papers punched and/or bound in the intermediate stacking unit 43 to the subsequent conveying means, the intermediate stacking unit 43 has a plate member 443, a U-shaped supporting plate 450 attached to the central portion of the lower surface of the plate member 443, a guide rod 449 supported on the supporting plate 450, a pin 451 horizontally extending from the side surface of the supporting plate 450, a curved lever 452 having a slot 452*a* formed in one end thereof so as to receive the pin 451 therein, and a V-shaped lever 461 of a roller unit 460 pivotally joined to the other end of the curved lever 452. The roller unit 460 has a delivery roller 462 rotatably supported on the curved lever 452 at the center of the same, two rollers 463 and 464, and a belt 465 extended around the delivery roller 462, the rollers 463 and 464. The delivery roller 462 is rotated by a shaft 466 rotated through the belt 465 by a printed recording paper conveying motor $M_1$. In stacking up printed recording papers, the fingers 440 and the projections 441 and 442 of the plate member 443 of the stopper 43*c* project upward respectively through the openings 431*a*, 431*b* and 431*c* to hold the printed recording papers by the upright lugs 441*a* of the projections 441. In delivering the printed recording papers, the stopper 43*c* is retracted and the delivery roller 462 is made to protrude from the upper surface of the inclined plate 43*a* to deliver the printed recording papers.

Figure 8:
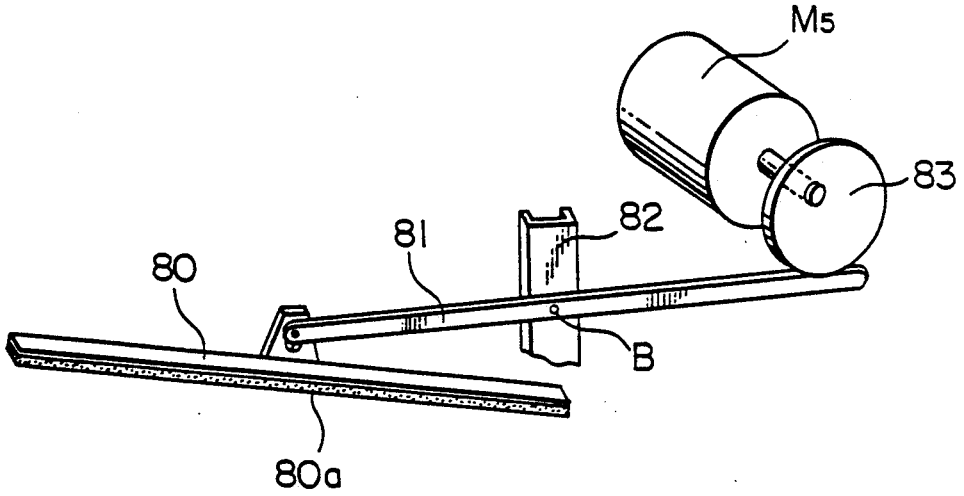
FIG. 8 is a perspective view of a holding bar driving mechanism.

Shown in FIG. 8 is metallic holding bar 80 for pressing a pile of printed recording papers at a position near a portion where the pile of printed recording papers stacked in the intermediate stacking unit 43 is punched or bound, and a driving mechanism for driving the holding bar 80. A compressible strip 80*a* is applied to the lower surface of the holding bar 80. The holding bar 80 has a central slot, and is suspended slidably at the central slot by a bar 81. The bar 81 is supported pivotally on a frame 82 for swing motion by a pin B, and one end of the bar 81 is in contact with the circumference of an eccentric cam 83, which is driven by a motor $M_5$ for driving the holding bar 80.

When the motor $M_5$ is actuated in synchronism with the punching or binding operation, the other end of the bar 81 is caused to move vertically by the eccentric cam 83 to hold a pile of printed recording papers by the dead weight of the holding bar 80.

Figure 9:
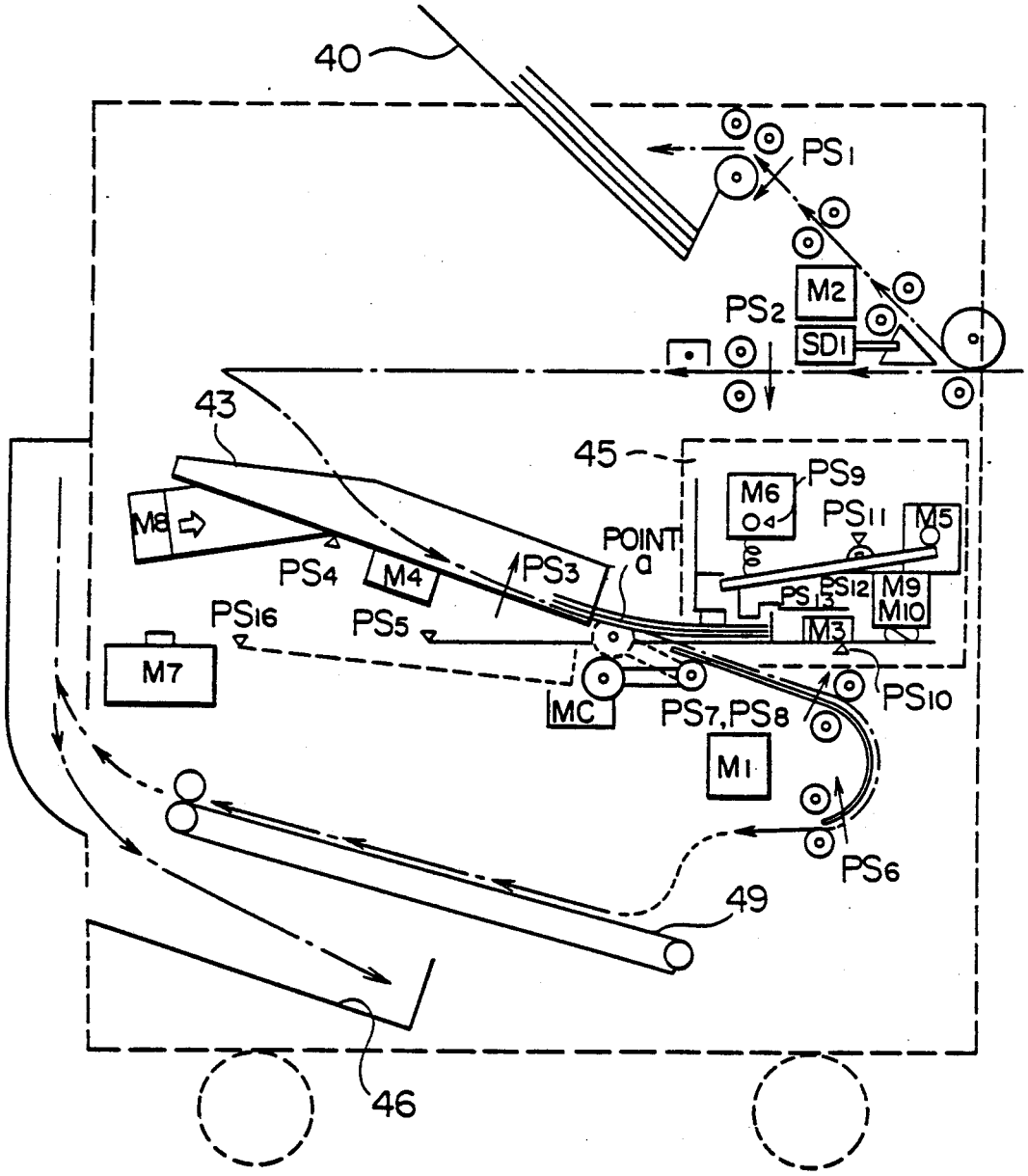
FIG. 9 is a view showing the arrangement of motors, sensors and a solenoid in the printed recording paper processing apparatus.

Referring to FIG. 9, the functions of the motors, the sensors and the solenoid will be itemized below.

Motor $M_1$: Conveyance of processed recording papers from the intermediate stacking unit 43 to the copy storage tray 46

Motor $M_2$: Conveyance of printed recording papers discharged from the copying machine 2 to the printed recording paper delivery tray 40 or to the intermediate stacking unit 43

Motor $M_3$: Moving the binding units 60 for positional adjustment

Motor $M_4$: Moving the side plates $43b_1$ and $43b_2$ of the intermediate stacking unit 43 for the adjustment of the interval between the side plates $43b_1$ and $43b_2$ Motor $M_5$: Moving the holding bar 80 for vertical motion in synchronism with the punching or binding operation Motor $M_6$: Driving the punching pins 56a, 56b, and 56c of the punching unit 50 for punching Motor $M_7$: Driving the plate member 443 of the stopper 43c for back-and-forth movement Motor $M_8$: Driving the blower to blow air over the inclined plate 43a of the intermediate stacking unit 43

Motor $M_9$ and $M_{10}$: Pressing staples of the binding units 60 to bind a pile of printed recording papers Sensor $PS_1$: Detection of delivery of a printed recording paper to the printed recording paper delivery tray 40

Sensor $PS_2$: Detection of delivery of a printed recording paper to the intermediate stacking unit 43

Sensor $PS_3$: Detection of the existence of printed recording paper in the intermediate stacking unit 43

Sensor $PS_4$: Detection of the side plates 43b$_1$ and 43b$_2$ at the respective home positions Sensor $PS_5$: Detection of the stopper 43c at a predetermined position Sensor $PS_6$: Detection of the delivery of a punched and/or bound copy of printed recording papers to the copy storage tray 46

Sensors $PS_7$ and $PS_8$: Detection of a punched and/or bound copy of printed recording papers at a predetermined position on the inclined plate 43a

Sensors $PS_9$: Detection of completion of one full turn of the output shaft of the Motor $M_6$ Sensors $PS_{10}$: Detection of the binding units 60 at the respective home positions Sensors $PS_{11}$: Detection of the output shaft of the holding bar operation motor $M_5$ at the home position Sensors $PS_{12}$ and $PS_{13}$: Detection of completion of one full turn of the respective output shaft of the motors $M_9$ and $M_{10}$ for driving the binding units 60

Sensors $PS_{14}$: Detection of retraction of the stopper 43c to a predetermined retracted position Solenoid $SD_1$: Switching the switching gate 42

Figure 10:
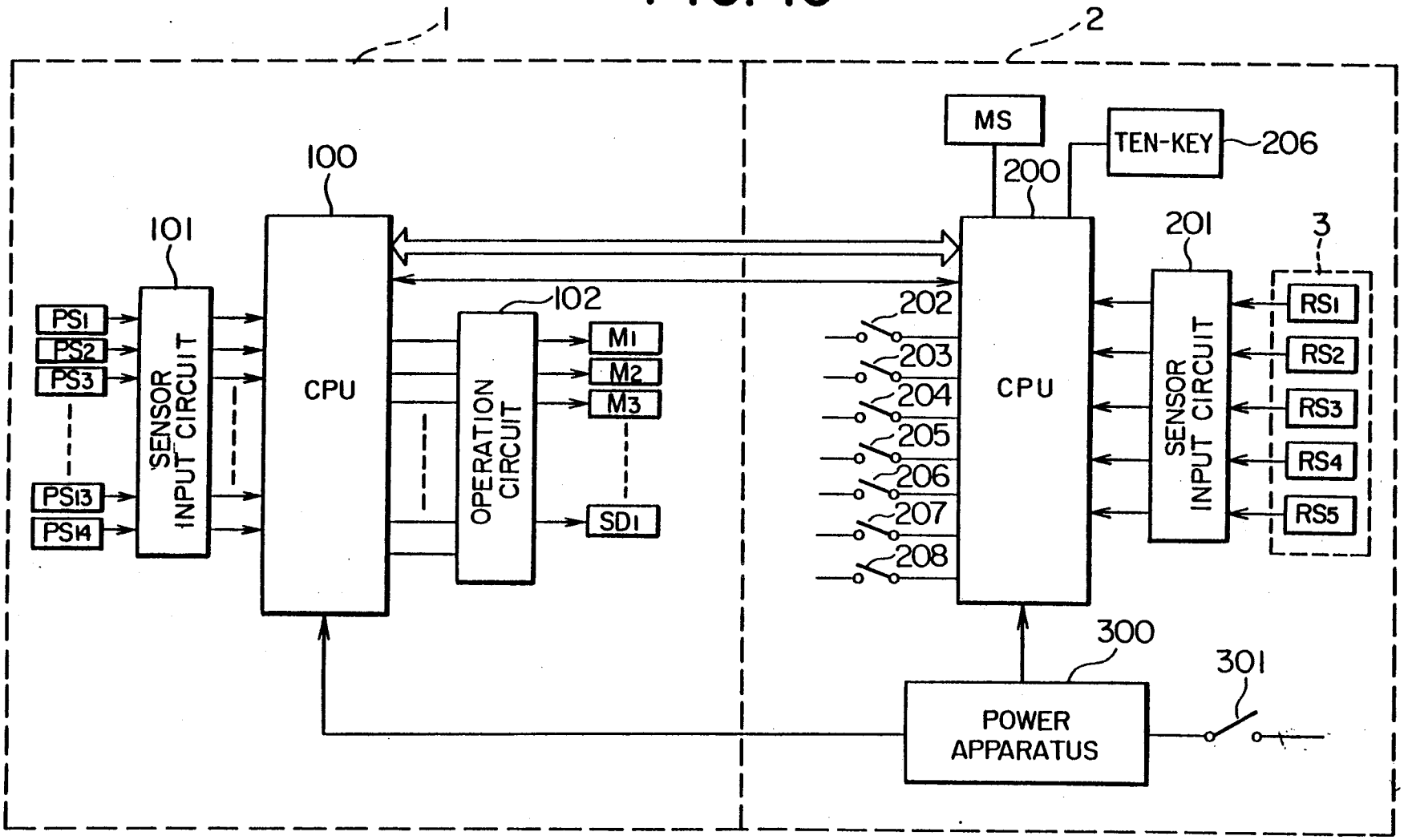
FIG. 10 is a block diagram of a control unit for controlling the printed recording paper processing apparatus and the copying machine.

Referring to FIG. 10, a first control circuit for controlling the operation of the printed recording paper processing apparatus 1 combined with the copying machine 2 comprises a first CPU (central processing unit) 100, a first input circuit 101 which receives detection signals from the sensors $PS_1$ to $PS_{14}$ and converts the detection signals into corresponding signals for processing by the CPU 100 and a first driving circuit 102 for driving the motors $M_1$ to $M_{10}$ and the solenoid $SD_1$. A second control circuit for controlling the copying machine 2 comprises the sensors $RS_1$ to $RS_5$ of the automatic document recirculating device 3, a second CPU 200, a second input circuit 201 which receives detection signals from the sensors $RS_1$ to $RS_5$ and converts the detection signals into corresponding signals for processing by the second CPU 200, a control panel provided with the copy start button 202, a paper size selecting button 203, a mode selecting button 204 for selecting a desired mode of operation of the printed recording paper processing apparatus 1, a binding position selecting button 205, a punching request button 206, an automatic document size detecting button 207 for instructing the automatic document recirculating device 3 to detect the size of the document and to decide automatically the size of recording papers to be used, numeric keys 208 for setting the number of copies to be produced or the number of printed recording papers to be produced, and a main switch 301.

Figure 11:
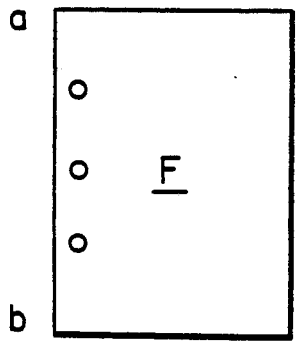
FIG. 11 is a plan view of assistance in explaining a manner of processing printed recording papers in accordance with the present invention.

Every time the paper size selecting button 203 is depressed, the selected paper size changes in the order of A3, B4, F4, A4 and B5. The selected paper size changes in that order again as the paper size selecting button 203 is further depressed repeatedly. A stacking mode is selected when the mode selecting button 204 is depressed once, a binding mode is selected when the same is depressed twice, and a punching and binding mode is selected when the same is depressed three times. When the mode selecting button 204 is depressed further, those operating modes are selected sequentially in that order. A corner a (FIG. 11) of a copy F is selected as a binding position when the binding position selecting button 205 is depressed once, a corner b (FIG. 11) of the copy F is selected when the same is depressed twice, and both the corners a and b are selected when the same is depressed three times. The binding position inputted by the selecting button 205 is coded in a 3-bit signal by the second CPU 200 of the copying machine and the 3-bit signal is transferred to the first CPU 100 of the printed recording paper processing apparatus 1. The punching request button 206 is used to enforce a punching operation. Then, a coded signal by CPU 200 is transferred to the first CPU 100.

The copying machine 2 is also provided with a power unit 300. When the main switch 301 provided in the control panel is closed, power is supplied not only to all the electrical components of the printed recording paper processing apparatus 1 but also to those of the copying machine 2.

The control panel of the copying machine is provided further with density adjusting means and magnification selecting means.

The printed recording paper processing apparatus 1 is able to operate in the following three modes.

(A) Stacking mode

The printed recording paper processing apparatus 1 performs neither the punching operation nor the binding operation, and hence the document is copied and the printed recording paper produced by the copying machine 2 is delivered directly to the printed recording paper delivery tray 40.

(B) Binding mode

A copy of printed recording papers is bound with staples. When this mode is selected, the binding position selecting button 205 is used to select the corner a or the corner b as a binding position, or both the corners a and b as binding positions.

(C) Punching and binding mode

A copy of printed recording papers is punched and bound. When this mode is selected, the punching request button 206 is used to request punching, and the binding position selecting button is used to select the corner a or the corner b, or both the corners as described in the binding mode.

The operation of the copying machine 2 and the printed recording paper processing apparatus 1 in producing two copies of three documents each of a size A4 will be described hereinafter by way of example.

First the main switch 301 of the copying machine 2 is closed and the three documents are placed one over another on the document tray 11 of the automatic document recirculating device 3 in the order of the third page, the second page and the first page from the bottom to the top.

When the main switch 301 is closed, the components are initialized. That is, the motor $M_3$ for moving the binding units 60 is turned in the normal direction by a predetermined number of steps (for example, twenty steps) and then the motor $M_3$ is turned in the reverse direction unit the sensor $PS_{10}$ gives a detection signal;

the motor $M_4$ is turned in the normal direction by a predetermined steps (for example, twenty steps), the same is turned in the reverse direction until the sensor $PS_4$ gives a detection signal; the motor $M_5$ is turned in the normal direction until the sensor $PS_{11}$ gives a detection signal; the motor $M_6$ is turned in the normal direction until the sensor $PS_9$ gives a detection signal; the motor $M_7$ is turned in the reverse direction for a predetermined time after the motors $M_5$ and $M_6$ have been initialized, and then the same is turned in the normal direction until the sensor $PS_5$ gives a detection signal; and the motors $M_9$ and $M_{10}$ are operated only when the digital outputs of sensors $PS_{12}$ and $PS_{13}$ are HIGH until the outputs of the sensors $PS_{12}$ and $PS_{13}$ become LOW.

Figure 12:
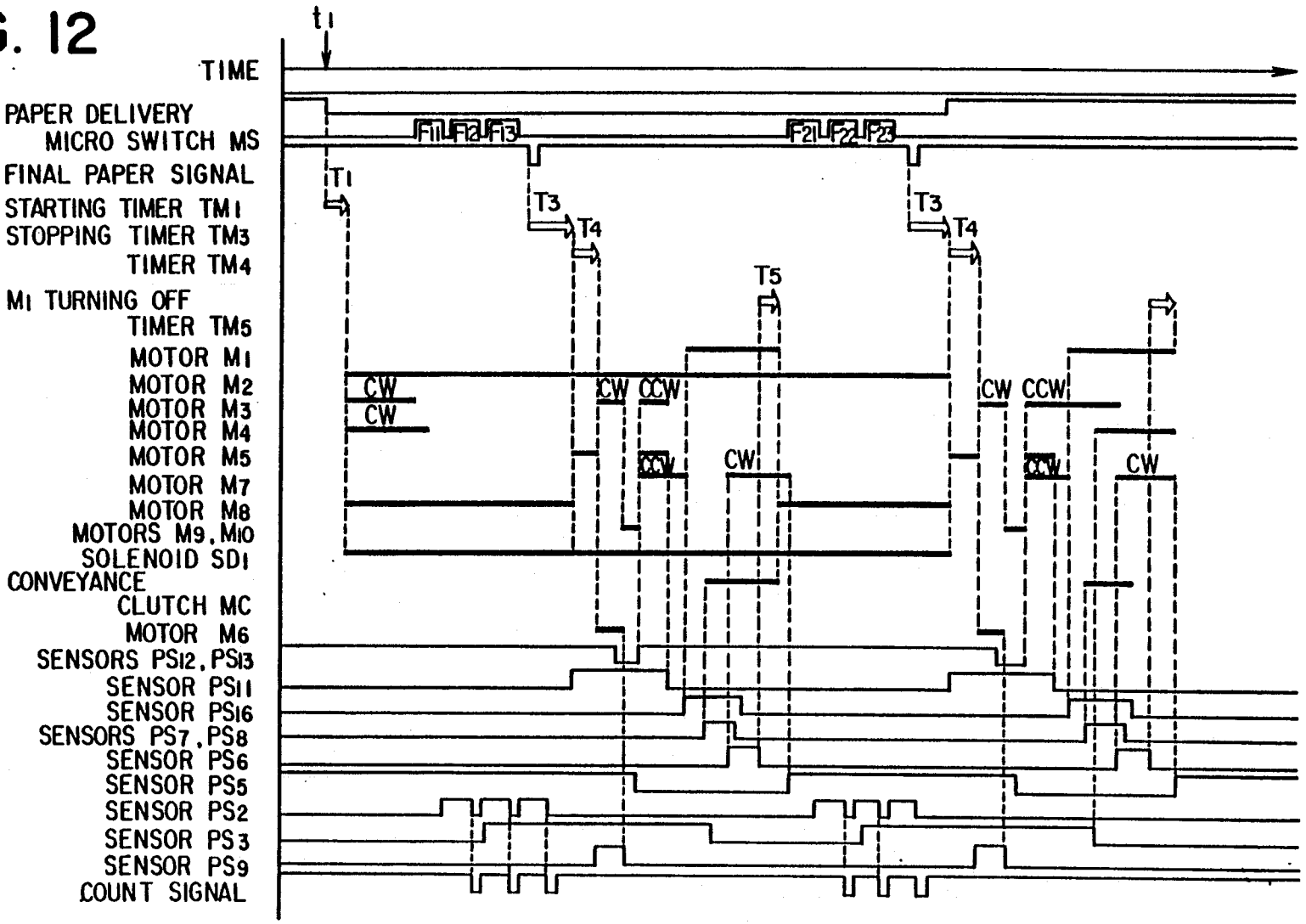
FIG. 12 is a time chart of assistance in explaining the operation of the printed recording paper processing apparatus in the punching and binding mode.

The operation in the punching and binding mode will be described hereinafter with reference to FIG. 12.

The punching and binding mode is selected by operating the mode selecting button 204, a recording paper size A4 is selected by operating the size selecting button 203, and punching is requested by depressing the punching request button 206.

Suppose that the copy start button 202 is depressed at time $t_1$. Then, the automatic document recirculating device 3 feeds the three documents one by one, the copying machine 2 copies the documents by the electrophotographic process to produce three printed recording papers $F_{11}$, $F_{12}$ and $F_{13}$ and discharges the three printed recording papers $F_{11}$, $F_{12}$ and $F_{13}$ for a first copy thereform, which is detected by a microswitch MS. The second CPU 200 counts the number of printed recording papers on the basis of the output signals of the microswitch MS. A short time after the coincidence of the number of the printed recording papers discharged from the copying machine (in this example, three) with the number of the output signals of the sensor $RS_5$ of the automatic document recirculating device 3 (in this example, three), a last paper signal is turned out and a binding start timer included in the first CPU 100 starts counting operation.

On the other hand, upon the elapse of a time period $T_1$ set by a start timer $TM_1$ in the first CPU 100 after the copy start button 202 has been depressed the motors $M_2$, $M_3$, $M_4$ and $M_8$ are actuated and the solenoid $SD_1$ is energized. Consequently, the rollers of the conveyor roller arrangement 41 start rotating, the two binding units 60 are shifted from the home positions toward the punching unit 50, the side plates 43$b_1$ and 43$b_2$ are moved from the home positions to positions where the interval between the side plates 43$b_1$ and 43$b_2$ is approximately equal to the width of the recording paper, respectively, the blower is driven, and the switching gate 42 is moved to the second position to guide the printed recording paper to the intermediate stacking unit 43. The side plates 43$b_1$ and 43$b_2$ are jogged sideways of each printed recording paper to stack up printed recording papers properly.

When the main switch 301 is closed or after the previous binding operation has been completed, the motor $M_3$ for shifting the binding units 60 and the motor $M_4$ for adjusting the position of the side plates are rotated in the normal direction by a predetermined number of steps corresponding to a selected recording paper size (for example, twenty steps), are turned in the reverse direction, and then the reverse rotation of the motor $M_3$ is stopped when the sensor $PS_{10}$ turns out a detection signal and the reverse rotation of the motor $M_4$ is stopped when the sensor $PS_4$ turns out a detection signal. Accordingly, the binding units 60 and the side are located at the respective home positions. In case the digital outputs of the sensors $PS_{10}$ and $PS_4$ are HIGH in rotating the motors $M_3$ and $M_4$ in the normal direction, the motors $M_3$ and $M_4$ are rotated in the normal direction until the outputs of the sensors $PS_{10}$ and $PS_4$ become LOW.

After the elapse of the time period $T_1$ from the time $t_1$, the motor $M_3$ rotates until the binding units 60 are moved to positions slightly wider than the precise positions of the paper size A4 and the motor $M_4$ rotates until the side plates 43$b_1$ and 43$b_2$ are moved to positions slightly wider than the positions of the paper size A4 in order to enable all the printed recording paper to be delivered, without fail, to a punching and binding position because the opening through which the printed recording papers are delivered is not relatively large.

The printed recording papers $F_{11}$, $F_{12}$ and $F_{13}$, sequentially delivered to the printed recording paper processing apparatus 1, are conveyed by the conveyor roller arrangement 44. The arrival of the printed recording paper at the stacking unit 43 is detected by the sensor $PS_2$.

Upon the lapse of a predetermined time $T_3$ set by a binding start timer $TM_3$ after the last paper signal has been provided, a timer $TM_4$ of the first CPU 100 for the operation of the holding bar 80 starts counting time, and the motor $M_5$ for driving the holding bar 80 is actuated. The blower is stopped at this moment. Upon the lapse of a predetermined time $T_4$ set by the timer $TM_4$, the motor $M_5$ is stopped and the motor $M_3$ is started again to move the two binding units 60 toward the punching unit 50. Upon the arrival of the binding units 60 at positions slightly narrower than the positions of the selected paper size A4, the motor $M_3$ is stopped. Then, the motors $M_9$ and $M_{10}$ for driving the binding units 60 are started. The rotation of each of the motors $M_9$ and $M_{10}$ is transmitted through gears 61 and 62 to drive the lever 63 for linear reciprocation, whereby the V-shaped lever is turned on the fulcrum A. Consequently, the lever 65 is turned and the pressing member 67 is lowered compressing the spring 66 to move the thin plate 68 downward along the guide 69, whereby one of the staples contained in the cartridge 70 is driven into the pile of the printed recording papers to bind them into a book. After the motors $M_9$ and $M_{10}$ have been stopped, the motor $M_3$ is reversed to shift the binding units 60 to the position slightly wider than the precise positions of the paper size A4, the motor $M_5$ is actuated, and then motor $M_5$ is stopped upon the detection of the motor $M_5$ at the home position by the sensor $PS_{11}$.

Upon the elapse of the set time $T_4$ set by the timer $TM_4$ of the CPU 100, the motor $M_6$ for driving the punching unit 50 is actuated. Then, as shown in FIG. 5, the driving shaft fixedly mounted with the three eccentric cams 54$a$, 54$b$ and 54$c$ at an angular pitch of 56° is rotated through the worm 51 and the worm wheel 53. In this embodiment, the phase of the eccentric cam 54$a$ is delayed by 56° with respect to that of the eccentric cam 54$c$, and the phase of the eccentric cam 54$b$ is delayed by 56° with respect to that of the eccentric cam 54$a$. Accordingly, the punching pins 56$a$, 56$b$ and 56$c$ are operated by the swing arms 55$a$, 55$b$ and 55$c$, respectively in different phases, so that a reduced load, as compared with a load that acts on the motor when all the punching pins are operated simultaneously, acts on the motor $M_6$ for driving the punching unit 50. The output digital signal of the sensor $PS_9$ changes from HIGH to LOW upon the detection of one full turn of the motor $M_6$ to stop the motor $M_6$.

On the other hand, the motor $M_7$ for driving the stopper is turned in the reverse direction to retract the rack 446 engaging the pinion 447 as shown in FIG. 4. Consequently, the plate member 443 is retracted along the guides 445. Since the grooves 445*a* of the guides 445 is inclined, the fingers 440 and the projections 441 are retracted downward from the openings 431*a*, 431*b* and 431*c* as the plate member 443 is retracted. The retraction of the projections 441, namely, the retraction of the upright lugs 441*a*, from the openings 431*b* allows the bound copy of the printed recording papers $F_{11}$, $F_{12}$ and $F_{13}$ to slide down along the including plate 43*a*. Upon the retraction of the stopper 43*c* to a predetermined position, the output signal of the sensor $PS_{14}$ becomes HIGH to stop the motor $M_7$ for driving the stopper 43*c*. At the same time, the motor $M_1$ is actuated to drive the delivery roller 462 through the shaft 466, the rollers 463 and 464 and the belt 465 (FIG. 7). Consequently, the copy of the printed recording papers $F_{11}$, $F_{12}$ and $F_{13}$ staying on the inclined plate 43*a* is caused to slide down along the inclined plate 43*a* by the delivery roller 462. Upon the detection of the front edge of the copy of the printed recording papers $F_{11}$, $F_{12}$ and $F_{13}$ by the sensors $PS_7$ and $PS_8$ disposed beside the inclined plate 43*a*, a clutch MC (FIG. 9) is engaged to rotate the conveyor rollers 47 and 48 to convey the copy. Upon the detection of the front edge of the copy by the sensor $PS_6$, the stopper driving motor $M_7$ is actuated to advance the plate member 443 by the mechanism shown in FIG. 4.

Upon the detection of the rear edge of the copy, the digital output signal of the sensor $PS_6$ becomes LOW, and then a timer $TM_5$ included in the first CPU 100 starts counting time. Upon the elapse of a predetermined time period $T_5$ set by the timer $TM_5$, the motor $M_1$ is stopped and the motor $M_8$ is actuated again to drive the blower. In the meantime, the stopper 43*c* is advanced to a predetermined position, and then the digital output signal of the sensor $PS_5$ becomes LOW to stop the stopper driving motor $M_7$.

The copy of the printed recording papers $F_{11}$, $F_{12}$ and $F_{13}$ thus conveyed is delivered to the copy storage tray 46 by copy conveying means 49.

The same copying, binding and punching cycle is repeated for a second copy of printed recording papers $F_{21}$, $F_{22}$ and $F_{23}$, and the second copy is delivered also to the copy storage tray 46.

As is apparent from the foregoing description, in the printed recording paper processing apparatus according to the present invention capable of receiving printed recording papers produced by feeding recording papers one at a time to a copying machine and subjecting the recording papers to the copying process, piling up the printed recording papers in the order of feed at a printed recording paper storing position, and punching and/or binding a pile of the printed recording papers at the printed recording paper storing position, the punching pins are driven sequentially for punching respectively at different phases and bending members are disposed near the bottom surfaces of the punching dies to bend punched scraps. Accordingly, a load that acts on the motor for driving the punching pins is small as compared with a load that acts on the motor for driving punching pins in the conventional printed recording paper processing apparatus in which the punching pins are driven simultaneously for punching, and the punched scraps are discharged smoothly without clogging the punching unit.

What is claimed is:

1. An apparatus for punching holes in a plurality of recording sheets for use in an image recording machine, the apparatus comprising:

a first sheet receiving means for stacking said recording sheets at a predetermined place;

a first conveyance means for conveying the recording sheets to said first sheet receiving means;

a sheet processing means for hole punching and binding the recording sheets stacked in said first sheet receiving means, said sheet processing means including means for selectively providing hole punching only, binding only, and both hole punching and binding;

a second sheet receiving means; and a second conveyance means for conveying said sheets from said sheet processing means to said second sheet receiving means.

2. The apparatus as claimed in claim 1, wherein said sheet processing means includes a hole punching apparatus having a die, said hole punching apparatus including an angled panel positioned at the exit of the die for bending the punched pieces exiting said die whereby the punched pieces are separated.

3. The apparatus as claimed in claim 1, wherein said first sheet receiving means comprises:

a sheet conveying stopping means for stopping said conveyed recording sheets where the sheet is processed and for selectively permitting the sheets to move away from the processing position after sheet processing;

a sheet positioning means adjustable to the size of the recording sheets for defining the receiving position of the recording sheets and aligning the edges of the sheets; and a sheet holding means for holding the sheets during processing.

4. The apparatus as claimed in claim 3, further comprising:

a third sheet receiving means;

a third conveyance means for avoiding the sheet processing means and conveying the recording sheets to said third sheet receiving means; and a conveyance direction change means for directing the recording sheets to either said first or said third conveyance means.

* * * * *